US008631781B2

(12) United States Patent
Boczek et al.

(10) Patent No.: US 8,631,781 B2
(45) Date of Patent: Jan. 21, 2014

(54) PISTON FOR AN INTERNAL COMBUSTION ENGINE

(75) Inventors: Sascha-Oliver Boczek, Dielheim (DE); Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 132 days.

(21) Appl. No.: 13/199,449

(22) Filed: Aug. 30, 2011

(65) Prior Publication Data

US 2013/0008404 A1 Jan. 10, 2013

(30) Foreign Application Priority Data

Jul. 5, 2011 (DE) ..... 10 2011 106 559

(51) Int. Cl.
*F02F 3/22* (2006.01)

(52) U.S. Cl.
USPC ..... 123/193.6; 123/41.35

(58) Field of Classification Search
USPC ..... 123/193.6, 41.35; 92/186; 29/888.04
See application file for complete search history.

(56) References Cited

U.S. PATENT DOCUMENTS

| | | | | |
|---|---|---|---|---|
| 4,180,027 | A | 12/1979 | Taylor | |
| 4,377,967 | A | 3/1983 | Pelizzoni | |
| 4,530,312 | A | 7/1985 | Kanda et al. | |
| 6,477,941 | B1 * | 11/2002 | Zhu et al. | 92/186 |
| 2008/0121204 | A1 * | 5/2008 | Scharp | 123/193.6 |
| 2009/0159037 | A1 * | 6/2009 | Messmer | 123/193.6 |
| 2010/0101527 | A1 | 4/2010 | Gniesmer | |
| 2010/0108016 | A1 * | 5/2010 | Scharp et al. | 123/193.6 |
| 2010/0108017 | A1 * | 5/2010 | Bing et al. | 123/193.6 |
| 2010/0122681 | A1 * | 5/2010 | Issler | 123/193.6 |
| 2010/0139480 | A1 | 6/2010 | Ohmori et al. | |
| 2010/0307446 | A1 | 12/2010 | Nodl | |
| 2011/0119914 | A1 * | 5/2011 | Janssen et al. | 29/888.04 |
| 2012/0000439 | A1 * | 1/2012 | Scharp et al. | 123/193.6 |
| 2012/0222305 | A1 * | 9/2012 | Scharp et al. | 29/888.042 |

FOREIGN PATENT DOCUMENTS

| | | |
|---|---|---|
| DE | 40 07 992 | 9/1990 |
| DE | 199 27 931 | 1/2001 |
| DE | 10 2007 018 932 | 10/2008 |
| DE | 10 2007 058 789 | 6/2009 |
| DE | 10 2008 011 922 | 9/2009 |
| DE | 10 2009 058 176 | 1/2011 |
| GB | 786 985 | 11/1957 |

OTHER PUBLICATIONS

German Search Report dated May 22, 2012 in German Patent Application No. 10 2011 106 559.1 with English translation of relevant parts.

International Search Report of PCT/DE2012/000673, mailed Dec. 11, 2012.

* cited by examiner

*Primary Examiner* — M. McMahon
(74) *Attorney, Agent, or Firm* — Collard & Roe, P.C.

(57) ABSTRACT

A piston for an internal combustion engine has an upper piston part and a lower piston part, which form an outer circumferential cooling channel. The piston has pin boss connections that lie opposite one another, at which pin bosses are provided, which have pin bores that define a center axis (M). The upper piston part and the lower piston part are connected with one another by way of outer joining surfaces and inner joining surfaces. A bridge that runs essentially parallel to the center axis (M) is configured in the lower piston part, in the region of the pin boss connections. The bridge has two longitudinal sides that delimit an upper bridge surface.

8 Claims, 2 Drawing Sheets

PISTON FOR AN INTERNAL COMBUSTION ENGINE

CROSS REFERENCE TO RELATED APPLICATIONS

Applicants claim priority under 35 U.S.C. §119 of German Application No. 10 2011 106 559.1 filed Jul. 5, 2011, the disclosure of which is incorporated by reference.

BACKGROUND OF THE INVENTION

1. Field of the Invention

The invention relates to a piston for an internal combustion engine, having an upper piston part and a lower piston part, which form an outer circumferential cooling channel. There are pin boss connections that lie opposite one another, at which pin bosses are provided. The pin bosses have pin bores that define a center axis and the upper piston part and the lower piston part are connected with one another by way of outer joining surfaces and inner joining surfaces.

2. The Prior Art

Pistons of this type are widely known. However, sufficient cooling of the piston during engine operation is a problem. With modern internal combustion engines, thermal stress is very high in the region of the upper piston part, so that sufficient cooling of the underside of the piston crown, in particular, must be guaranteed.

SUMMARY OF THE INVENTION

It is therefore an object of the present invention to provide a piston in which cooling of the underside of the piston crown is guaranteed, without disproportionately increasing the weight of the piston.

This object is accomplished according to the invention by a piston having a bridge that runs essentially parallel to the center axis (M) in the region of the pin boss connections. The bridge has two longitudinal sides that delimit an upper bridge surface.

The bridge provided according to the invention forms a partially open additional cooling cavity below the piston crown. The upper bridge surface collects the cooling oil that is present below the piston crown and passes it back in the direction of the underside of the piston crown, on the basis of the Shaker effect. In this manner, additional cooling of the underside of the piston crown is achieved. The partially open cooling cavity formed by the bridge provided according to the invention does not disproportionately increase the weight of the piston, as would be the case with a closed cooling cavity. Furthermore, heated cooling oil can run off in the direction of the pin bosses and be replaced by fresh cooling oil.

In one embodiment of the invention, the bridge is configured in one piece with the lower piston part. In this way, a particularly simple production method, for example forging, is possible.

Preferably, at least the upper bridge surface is disposed above the inner joining surface, in order to allow particularly effective return of the cooling oil in the direction of the underside of the piston crown.

If a depression is configured in the upper bridge surface, a greater amount of cooling oil can be collected in it and cooling of the underside of the piston crown can be further improved.

The two longitudinal sides of the bridge can extend essentially parallel to one another, but they can also run essentially convex or concave relative to one another. In this way, the piston structure can be adapted particularly well to the requirements of an individual case.

Preferably, the two longitudinal sides of the bridge run divergently with reference to the center axis. In the case of this embodiment, in particular, it is particularly advantageous if the lower edges of the longitudinal sides are configured as edges that narrow at an acute angle. In this case, the longitudinal sides can act as cooling oil run-off surfaces and/or the lower edges can act as cooling oil drip edges. In this way, the piston pin can be additionally lubricated, in a particularly effective manner.

If the lower edges of the longitudinal sides are disposed below the inner joining surfaces, an almost closed inner cooling cavity is formed, in which a particularly large amount of cooling oil can be collected, so that cooling of the underside of the piston crown is further improved.

Preferably, at least the lower piston part is configured as a forged part. In the case of this embodiment, in particular, the bridge can be forged in one piece with the lower piston part and can be machined using a chip-producing method. This production method can be implemented easily and cost-advantageously.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
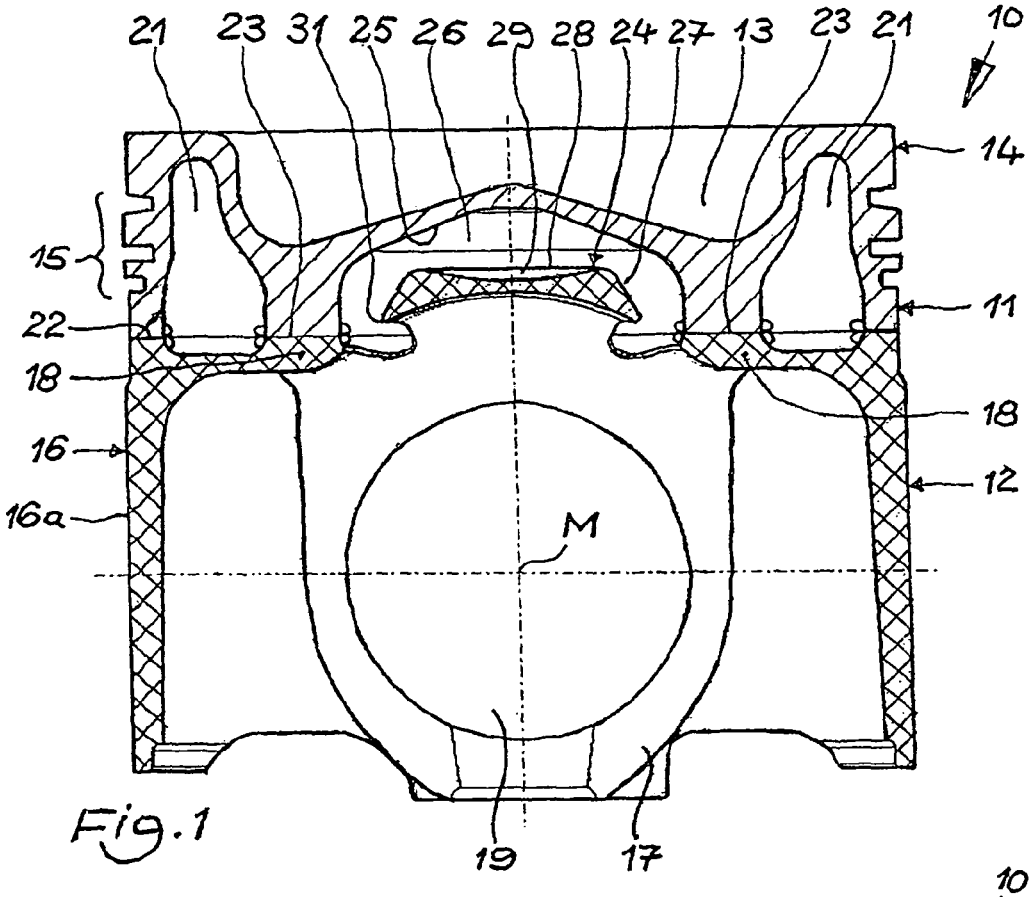
FIG. 1 shows a sectional view of a first embodiment of a piston according to the invention.
Figure 2:
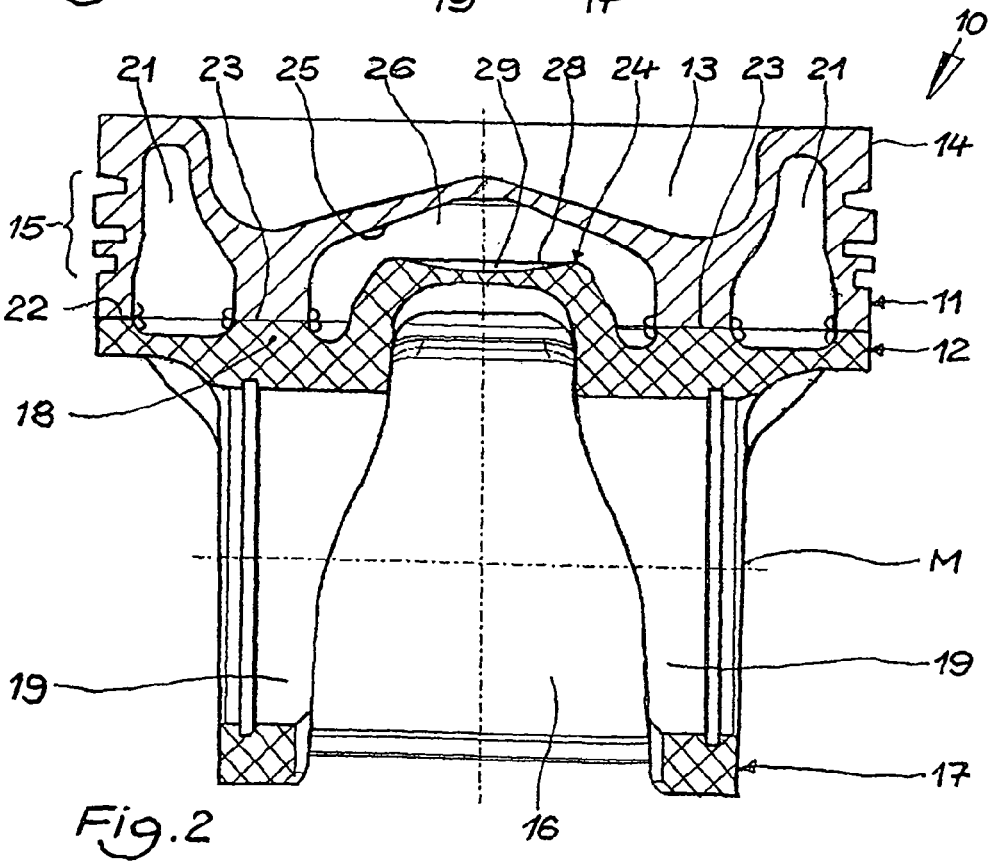
FIG. 2 shows a sectional view the piston according to FIG. 1 in a representation rotated by 90°.
Figure 3:
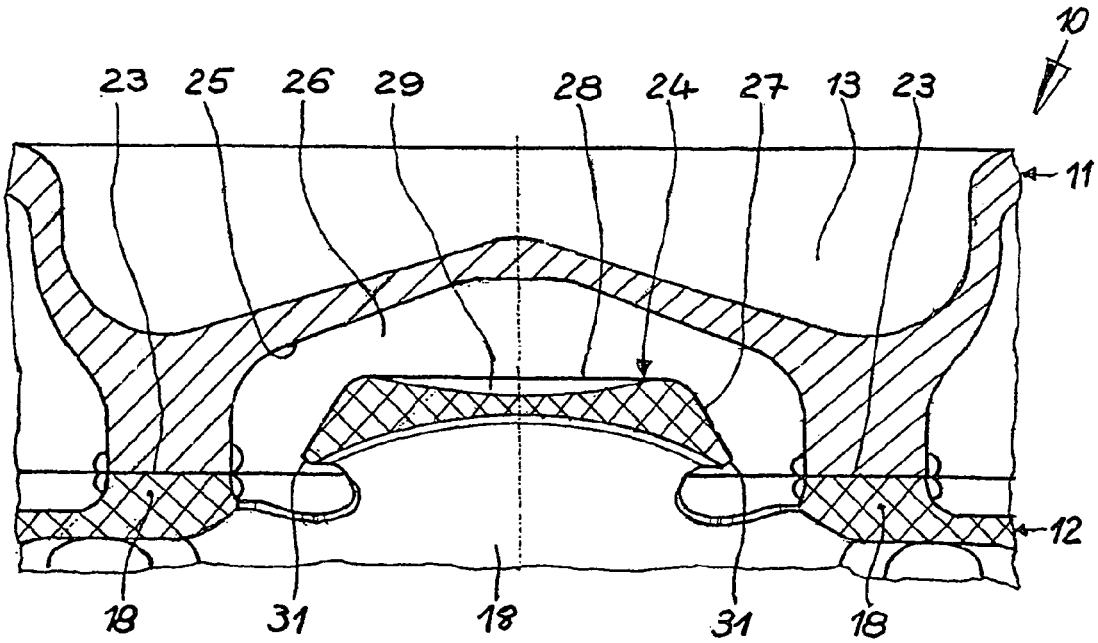
FIG. 3 shows the piston according to FIG. 1 in an enlarged partial representation.

Referring now in detail to the drawings and, in particular, FIGS. 1 to 3 show a first exemplary embodiment of a piston 10 according to the invention. Piston 10 according to the invention is composed of an upper piston part 11 and a lower piston part 12. Lower piston part 12 is forged from a steel material. Upper piston part 11 has a combustion bowl 13, a circumferential top land 14, as well as a circumferential ring belt 15 having ring grooves for accommodating piston rings (not shown). Lower piston part 12 has a piston skirt 16 having working surfaces 16*a*, pin bosses 17, and pin boss connections 18. Pin bosses 17 are radially set back toward the inside, in known manner, relative to the ring belt 15. Piston 10 is a so-called box piston. The present invention can, of course, also be implemented with other piston types. Pin bosses 17 are provided with pin bores 19 for accommodating a piston pin (not shown). Pin bores 19 define a center axis M. Upper piston part 11 and lower piston part 12 form a circumferential outer cooling channel 21. Upper piston part 11 and lower piston part 12 are connected with one another by way of an outer joining seam 22 and an inner joining seam 23, for example by means of a force fit, a snug fit, or by a welding or soldering method, preferably by a friction-welding method.

Outer joining seam 22 is formed from outer circumferential joining surfaces of upper piston part 11 and the lower piston part 12, respectively, which are connected with one another. Inner joining seam 23 is formed from the inner circumferential joining surfaces of upper piston part 11 and lower piston part 12, respectively, which are connected with one another.

According to the invention, lower piston part 12 has a bridge 24 in the region of pin boss connections 18. Bridge 24 forms a partly open inner cooling cavity 26 with underside 25 of combustion bowl 13, i.e. with underside 25 of the piston crown. In the exemplary embodiment, bridge 26 is connected with lower piston part 12 in one piece. If lower piston part 12 is a forged part, bridge 24 can also be forged, and subsequently machined using a chip-producing method. Bridge 24 has two longitudinal sides 27 that extend essentially parallel in the exemplary embodiment, and delimit an upper bridge surface 28. In the exemplary embodiment, an approximately bowl-shaped depression 29 is formed into upper bridge surface 28. The two longitudinal sides 27 run divergently with reference to the center axis M defined by pin bores 19. In the exemplary embodiment, lower edges 31 of longitudinal sides 27 are configured as edges that narrow at an acute angle. This configuration can take place within the course of the chip-producing machining of bridge 24. Longitudinal sides 27 serve as cooling oil run-off surfaces for the cooling oil collected in the depression and flowing out of it, while lower edges 31 act as drip edges for this cooling oil. Additional lubrication of the piston pin is achieved in this manner.

In the embodiment according to FIGS. 1 to 3, bridge 24 is disposed completely above inner joining seam 23.

Figure 4:
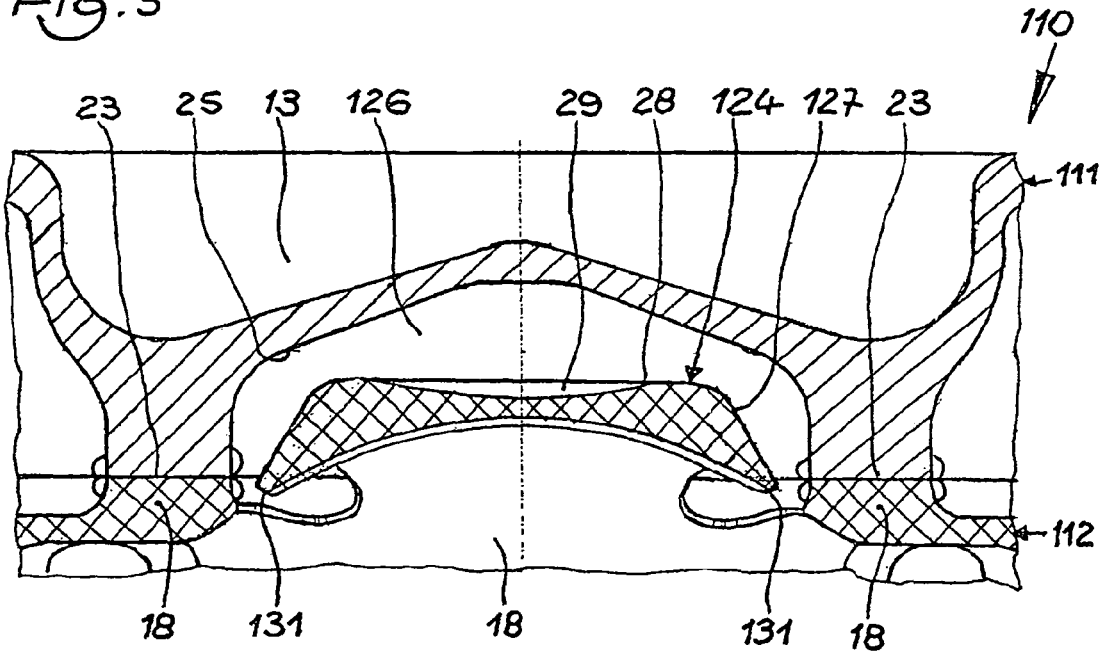
FIG. 4 shows another embodiment of a piston according to the invention, in an enlarged sectional representation.

FIG. 4 shows another embodiment of a piston 110 according to the invention, composed of an upper piston part 111 and a lower piston part 112. Piston 110 essentially corresponds to piston 10 according to FIGS. 1 to 3, so that the same piston structures are provided with the same reference symbols, and reference is made, in this regard, to the description of FIGS. 1 to 3.

The significant difference in this embodiment consists in that bridge 124 of piston 110 has longitudinal sides 127, the lower edges 131 of which are disposed below inner joining seam 23 between upper piston part 111 and lower piston part 112. In this way, an almost closed inner cooling cavity 126 is formed, so that particularly effective cooling of underside 25 of the combustion bowl 13, i.e. underside 25 of the piston crown, is guaranteed.

Accordingly, while only a few embodiments of the present invention have been shown and described, it is obvious that many changes and modifications may be made thereunto without departing from the spirit and scope of the invention.

What is claimed is:

1. A piston for an internal combustion engine, comprising:

an upper piston part having a combustion bowl with an underside;

a lower piston part connected with the upper piston part by way of outer joining surfaces and inner joining surfaces, to form an outer circumferential cooling channel;

pin boss connections that lie opposite one another, at which pin bosses are provided, said pin bosses having pin bores that define a center axis (M); and a bridge configured in the lower piston part, said bridge running essentially parallel to the center axis (M), in a region of the pin boss connections, and having two longitudinal sides that delimit an upper bridge surface, wherein the bridge forms a partially open cooling cavity with the underside of the combustion bowl, and wherein a depression is configured in the upper bridge surface.

2. The piston according to claim 1, wherein the bridge is configured in one piece with the lower piston part.

3. The piston according to claim 1, wherein at least the upper bridge surface is disposed above the inner joining surfaces.

4. The piston according to claim 1, wherein the two longitudinal sides run divergently with reference to the center axis (M).

5. The piston according to claim 1, wherein lower edges of the longitudinal sides are configured as edges that narrow at an acute angle.

6. The piston according to claim 1, wherein lower edges of the longitudinal sides are disposed below the inner joining surfaces.

7. The piston according to claim 1, wherein at least the lower piston part is configured as a forged part.

8. The piston according to claim 7, wherein the bridge is forged in one piece with the lower piston part and machined using a chip-producing method.

* * * * *